US005584530A

United States Patent [19]

Rogers et al.

[11] Patent Number: 5,584,530

[45] Date of Patent: *Dec. 17, 1996

[54] SEATING UNIT WITH STORAGE RECEPTACLE

[75] Inventors: W. Clark Rogers, Denton; D. Stephen Hoffman, High Point, both of N.C.

[73] Assignee: Ultra-Mek, Inc., Denton, N.C.

[ * ] Notice: The term of this patent shall not extend beyond the expiration date of Pat. No. 5,466,041.

[21] Appl. No.: 129,762

[22] Filed: Sep. 30, 1993

[51] Int. Cl.[6] ..... A47C 7/62

[52] U.S. Cl. ..... 297/188.1; 297/334; 297/463.1

[58] Field of Search ..... 297/313, 334, 297/331, 337, 1, 2, 188, 192, 193, 129, DIG. 10, 248, 105, 108, 106, 188.01, 188.08, 188.09, 188.1, 463.1

[56] References Cited

U.S. PATENT DOCUMENTS

| | | | |
|---|---|---|---|
| 1,167,597 | 1/1916 | Riehm . | |
| 1,309,097 | 7/1919 | Markwick . | |
| 2,292,618 | 8/1942 | Davis | 155/91 |
| 2,679,891 | 6/1954 | Rubin . | |
| 2,696,870 | 12/1954 | Mende . | |
| 2,714,418 | 8/1955 | Malco | 155/105 |
| 2,907,378 | 10/1959 | Barecki | 155/191 |
| 2,950,753 | 8/1960 | Gleitsman et al. . | |
| 3,026,141 | 3/1962 | Welles . | |
| 3,147,040 | 9/1964 | Easterbrook | 297/338 |
| 3,596,991 | 8/1971 | McKee et al. | 297/326 |
| 3,746,391 | 7/1973 | Novak . | |
| 4,690,457 | 9/1987 | Poncy et al. | 297/337 |
| 4,838,612 | 6/1989 | Cross | 297/338 |
| 4,938,533 | 7/1990 | Thielois | 297/337 |
| 5,082,327 | 1/1992 | Crisp | 297/313 |

FOREIGN PATENT DOCUMENTS

| | | |
|---|---|---|
| 269414 | 3/1969 | Australia . |
| 920436 | 4/1947 | France . |
| 3222407 | 10/1982 | Germany . |

*Primary Examiner*—Milton Nelson, Jr.
*Attorney, Agent, or Firm*—Bell, Seltzer, Park & Gibson, P.A.

[57] ABSTRACT

A seating unit having a movable seat is disclosed. The seat is movable between a closed position, in which the seating surface of the seat is generally horizontally disposed, and an open position in which the seating surface is generally vertically disposed and forwardly facing, the lower surface of the movable seat confronts the front wall of the seating unit, and the front edge portion of the seat is adjacent the underlying surface. Mechanisms suitable for effecting such movement are also disclosed.

21 Claims, 2 Drawing Sheets

SEATING UNIT WITH STORAGE RECEPTACLE

FIELD OF THE INVENTION

The present invention relates generally to seating units, and relates more specifically to seating units having a storage receptacle beneath a portion of the seating surface.

BACKGROUND OF THE INVENTION

Commonly, homeowners struggle to find convenient storage space for small items kept within the home. Desks, bureaus, end tables, and the like can provide storage space, but most homeowners can use more. This is particularly true for homeowners that spend a great deal of time in a particular room of their home, such as the living room or den in which they gather to talk, listen to music, or watch television; most would like a convenient storage receptacle that services these rooms without taking up additional floor space.

Storage receptacles positioned beneath seats are known for seating units outside the living room. See, e.g., U.S. Pat. No. 2,679,891 to Rubin, which discloses a sewing machine stored beneath a chair; U.S. Pat. No. 3,026,141 to Welles, which discloses a drawer that fits beneath an automobile seat; U.S. Pat. No. 2,907,378 to Barecki, which discloses an automobile seat which pivots to allow the front portion of the seat surface to rise and thereby provide access to a seating unit beneath. However, none of these configurations would be suitable for use with a sofa, love seat, easy chair, or the like, as each has both performance and aesthetic shortcomings.

In view of the foregoing, it is an object of the present invention to provide a seating unit having an associated storage receptacle that is easily accessed.

It is another object of the present invention to provide a seating unit with an associated storage receptacle that can be integrated into virtually any seating unit style without sacrificing aesthetic appeal.

It is an additional object of the present invention to provide a mechanism suitable for use with the aforementioned seating units.

SUMMARY OF THE INVENTION

These and other objects are satisfied by the present invention, which includes (a) a seating unit including a base adapted for supporting the seating unit on an underlying surface having upright wall means, a movable seat portion having a seating surface, a lower surface opposed to said seating surface, and a front edge portion; and (b) means interconnecting the base and the movable seat for moving the movable seat between a closed position, in which the seating surface of the movable seat is disposed generally horizontally, and an open position, in which the seating surface of the movable seat is generally vertically disposed and forwardly facing, the lower surface of the movable seat confronts the upright wall means, and the front edge portion is adjacent the underlying surface. Preferably, the moving means comprises a pair of four-bar linkages.

DETAILED DESCRIPTION OF THE INVENTION

The present invention will now be described herein in greater detail. The illustrated embodiment is not intended to be limiting; rather, this embodiment is included to provide those skilled in this art with a full and complete understanding of the invention.

The present invention relates to a seating unit having a storage receptacle within the cavity present beneath the seat surface. The seating unit can be of any size and style, such as a conventional three-seat sofa, love seat, easy chair, pit-style sofa, and the like, that is large enough to house a storage receptacle beneath the seat surface. In the closed position, the seat residing above the storage receptacle (the "movable seat") serves as an object of body support for a seated occupant of the seating unit. Moving the movable seat to the open position provides access to the storage receptacle within the cavity of the sofa.

As used herein, "forward", "forwardly" and "front" all refer to the direction parallel with the floor extending from the backrest of a seating unit toward the seating surface of the seating unit. Conversely, the terms rear", "rearward", and "rearwardly" all refer to the direction parallel with the floor extending from the seating surface toward the backrest. The term "lateral" refers to the direction parallel with the floor, perpendicular to the forward and rearward directions, and extending away from the center of the seating unit. The terms "medial," "inward" and "inboard" all refer to the direction that is the converse of the lateral direction, i.e., the direction parallel with the floor, perpendicular to the forward direction, and extending from the periphery of the seating unit toward its center.

Figure 1:
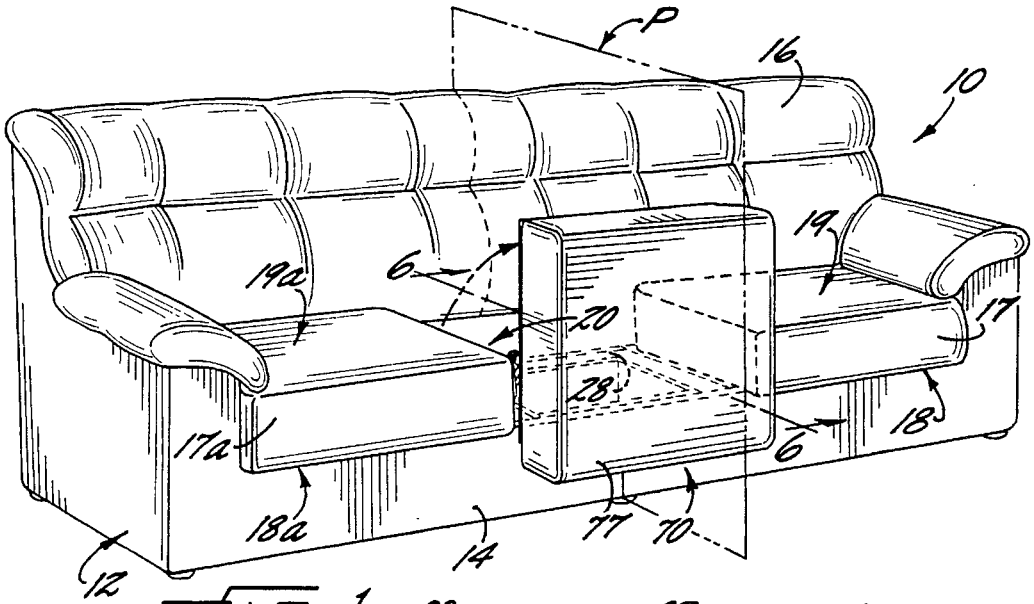
FIG. 1 is a front perspective view of a sofa having a movable center seat wherein the center seat is in the open position.

Referring now to the drawings, a sofa illustrated broadly at 10 is shown in FIG. 1. The sofa 10 includes a base 12, a front wall 14, a pair of seat cushion support surfaces 18, 18*a* positioned above the base 12, and a backrest 16 fixed to the rearward portion of the base 12 rearward of the seat cushion support surfaces 18, 18*a*. Seat cushions 17, 17*a* rest atop the seat cushion support surfaces 18, 18*a* and provide lateral seating surfaces 19, 19*a*.

The base 12 also includes a storage cavity 20 (FIG. 2) positioned rearwardly from the front wall 14 and inwardly from and below the plane defined by the lateral seat cushion support surfaces 18, 18*a*. The cavity 20 is framed by a storage cavity frame 21 fixed to the base 12 about the upper periphery of the cavity 20. The mounting frame 21 comprises a front panel 22 fixed to the rearward surface of the base front wall 14, a pair of side panels 24, 24*a* fixed to reside just below and inwardly from the inboard portion of the lateral seat cushion support surfaces 18, 18*a*, and a rear panel 28 (shown phantom line in FIG. 1) fixed beneath the forward portion of the backrest 16. An upper front shelf 23

(FIG. 2) is fixed to the rearward surface of the front panel 22; a lower front shelf 25 is fixed to the rearward surface of the front wall 14. A rectangular storage bin 26 lines the lower portion of the cavity 20 and provides a receptacle for items to be stored within the sofa 10. A forward lip 27 of the bin 26 rests upon the lower front shelf 25, and the rear portion of the bin 26 is supported by a similar block shelf (not shown) fixed to the rear panel 28.

The sofa 10 also includes a movable seat 70 (seen best in FIG. 2) that comprises a mounting frame 71, a cushion support plate 75, and a seat cushion 77. The mounting frame 71 comprises a front panel 72, a pair of side panels 73, 73*a*, and a rear panel 78 that are fixed to the underside of the cushion support plate 75 to form a hollow square projection extending downwardly from the support plate 75. The mounting frame 71 is sized to fit within and mate with the storage cavity frame 21 and thereby provide a laterally steady seating surface. The seat cushion 77 rests upon the support plate 75 and is fixed at its edges to the periphery of the support plate 75.

The movable seat 70 is movable between a closed position, wherein the movable seat 70 is generally horizontally disposed above the storage cavity 20 (FIG. 3), and an open position, wherein the movable seat 70 resides in a generally vertical disposition forwardly of the base 12 (FIG. 6), the lower portion of the movable seat 70 (represented in this embodiment by the lower surface portion 74 of the front panel 72 and the lower surfaces 76, 76*a* of the side panels 73, 73*a*) confronts the front wall 14, and the front edge portion 81 (FIG. 6) of the movable seat 70 is adjacent the surface S underlying the seating unit 10. In the closed position (FIG. 3), the lower surface portion 74 of the front panel 72 rests upon the upper block shelf 23, the forward surface 79 of the front panel 72 is rearward of and adjacent the front panel 22 of the cavity frame 21, and the lateral surfaces 80, 80*a* of the side panels 73, 73*a* are inboard and adjacent the side panels 24, 24*a* of the cavity frame. In this position, the seating surface 82 of the center seat cushion 77 is essentially coplanar with the seating surfaces 19, 19*a* of the lateral seat cushions 17, 17*a*, which slope downwardly slightly from front to rear. Those skilled in this art will appreciate that, as used herein, a "generally horizontal disposition" of the movable seat 70 is intended to include dispositions of the seating surface 82 which the seat surface is horizontal, slopes downwardly slightly from front to rear, or even slopes upwardly from front to rear, dependent upon the design of the seating unit. As used herein, a "generally vertical disposition" of the movable seat 70 means that the movable seat is disposed so that the angle formed between the top surface of the movable seat and the underlying floor is between about 60 and 120 degrees. A vertical disposition of the movable seat 70 forming an angle of between 80° and 100° between the underlying floor S and the movable seat 70 is preferred.

Figure 2:
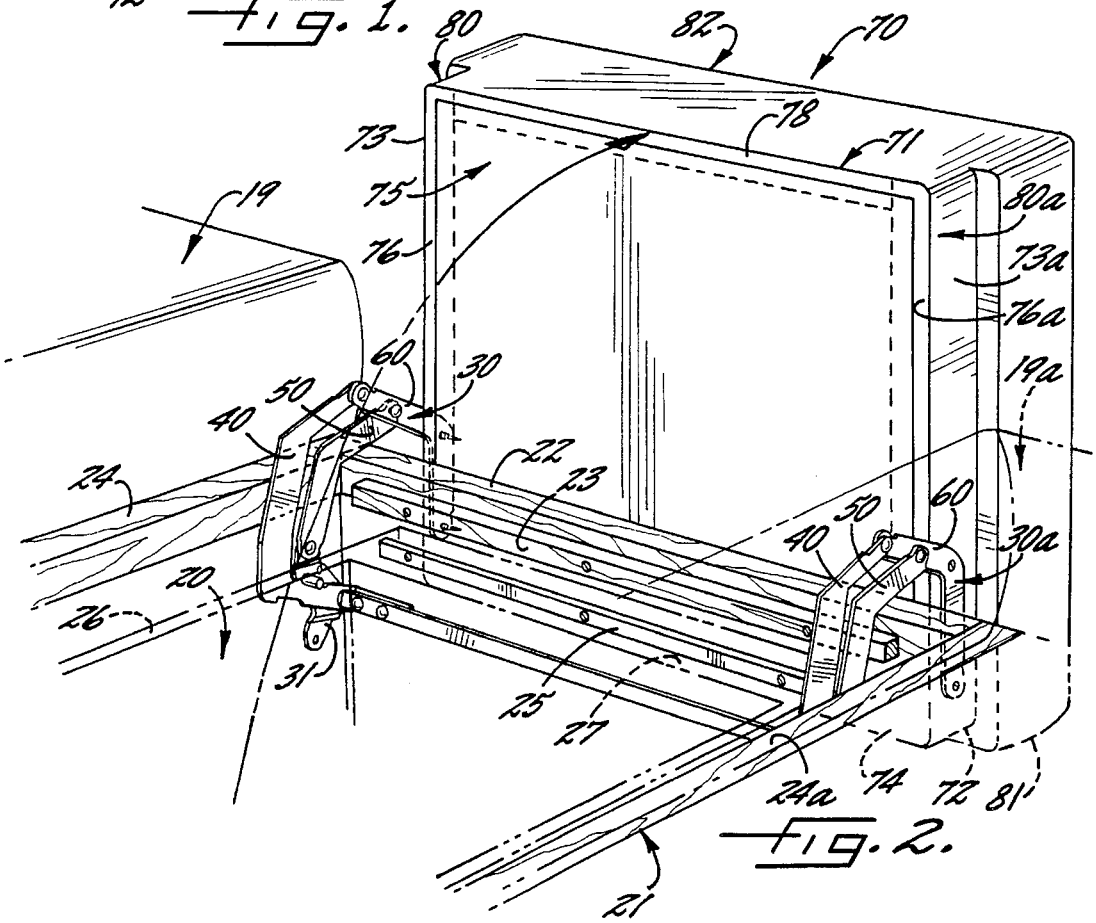
FIG. 2 is an enlarged rear perspective view of a movable seat in the open position and the mechanisms employed to move the seat between the closed and open positions.
Figure 3:
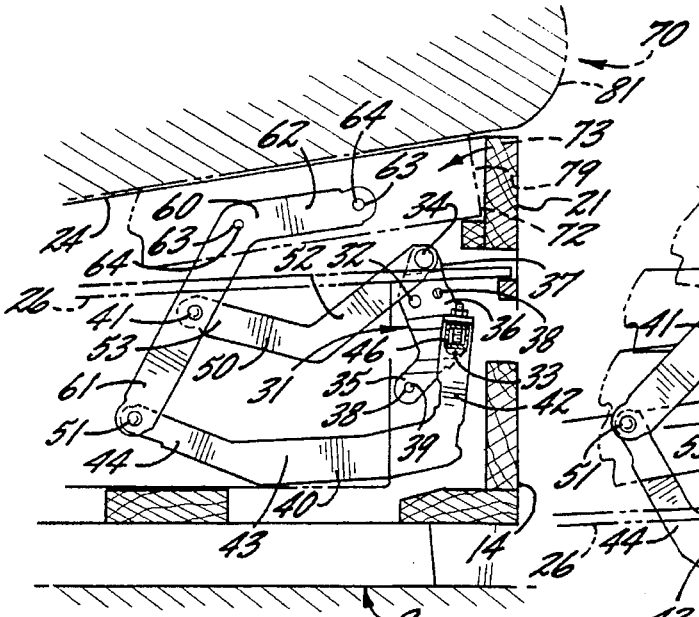
FIG. 3 is a cross-sectional view of a movable seat in the closed position.

The movement of the movable seat 70 relative to the base 12 is controlled by a pair of movable seat mechanisms 30, 30*a* (FIG. 2). Each of the movable seat mechanisms 30, 30*a* comprises a mounting bracket 31, a rear pivot link 40, a front pivot link 50, and a movable seat mounting bracket 60 (FIG. 3). The movable seat mechanisms 30, 30*a* are mirror images of one another about a plane of symmetry P (FIG. 1) parallel to and equidistant between the side panels 24, 24*a* of the storage cavity 20. In the interest of clarity and brevity, only the movable seat mechanism 30 will be described in detail herein; those skilled in this art will appreciate that this discussion is equally applicable to the mirror image movable seat mechanism 30*a*. Those skilled in this art will also appreciate that, although the illustrated mechanism configuration is preferred, there are any number of alternative mechanism configurations, including both four-bar linkages and other types, that can control the movement of the movable seat 70 from the closed position to the open position illustrated herein. As used herein, a "four-bar linkage" is intended to mean a hinged chain of links having one rotational degree of freedom and equivalent structures, such as a slider-crank mechanism, see, e.g., Paul, *Kinematics and Dynamics of Planar Machinery* (Prentice-Hall, Inc. 1979), and is intended to encompass mechanical configurations having multiple interconnected four-bar linkages.

The mounting bracket 31 (FIGS. 3 through 6) comprises a lower arm 35, a central arm 36 fixed obtusely to the forwardmost portion of the lower arm 35 and extending upwardly therefrom, and an upper arm 37 fixed obtusely to the uppermost end of the central arm 36 and extending generally upwardly therefrom. The mounting bracket 31 includes at opposite ends apertures 38 which receive threaded fasteners 39 for fixed attachment to the forward portion of the side panel 24 of the cavity frame 21. Positioned near the lower end of the central arm 36 is a pivot 33 for pivotal interconnection with the rear pivot link 40; also, a pivot 34 is positioned on the upper arm 37 upwardly from the pivot 33 for pivotal interconnection with the front pivot link 50. Although the mounting bracket 31 is illustrated herein, those skilled in the art will appreciate that any means that provides the pivots 33, 34 for pivotal movement of the rear and front pivot links 40, 50 relative to the side panel 24 is suitable for use with the present invention. Exemplary alternatives include a mounting plate, sleeve bushings recessed in or projecting from the side panel 24 or even apertures in the side panel 24 itself adapted to receive a threaded fastener, a pivot pin, and the like. The central arm 36 includes in its upper portion a stop pin 32 that projects inwardly to interfere with and cease the motion of the rear pivot link 40 as it reaches the open position.

The front pivot link 50 is pivotally attached to the mounting bracket 31 at the pivot 34 located on the upper portion of the upper arm 37 of the mounting bracket 31. Those skilled in this art will understand that this pivot, as well as the other pivots illustrated herein, can comprise any means which permits pivotal movement of one link upon another, including rivets, nuts and bolts, pivot pins, and the like. The front pivot link 50 has a lower arm 52 and an upper arm 53 which are fixed to one another to form an angle of approximately 135°. The upper arm 53 is pivotally connected with the movable seat mounting bracket 60 at an upper rear pivot 41 located at the end of the upper arm 53 opposite its attachment thereof with the lower arm 52.

The rear pivot link 40 is pivotally interconnected with the mounting bracket 31 at the pivot 33 located on the central arm 36 of the mounting bracket 31. The rear pivot link comprises a lower arm 42, a central arm 43, and an upper arm 44. The lower arm 42 is fixed to the central arm 43 so that the angle formed therebetween is approximately 160°. The upper arm 44 is fixed to the central arm 43 at approximately a 150° angle. At the end of the lower arm 42 opposite the central arm 43, a stabilizer tube 46 of square cross-section is fixed; this stabilizer 46 extends to a fixed attachment at the same location on the lower arm of the front pivot link of mechanism 30*a* on the opposite side of the storage cavity 20. The stabilizer tube 46 acts to unify the movement of the mechanisms 30, 30*a*, and to provide lateral stability.

The movable seat mounting bracket 60 comprises a lower arm 61 and upper arm 62 fixed to the lower arm 61 so that the angle formed therebetween is approximately 135°. The upper arm 62 includes two mounting apertures 63 that receive threaded fasteners 64 for attachment of the mounting bracket 60 to the side panels 73, 73*a* of the movable seat 70. The mounting bracket 60 is fixed to the panels 73, 73*a* so that the upper arm 62 is disposed generally horizontally in the closed position and the lower arm extends downwardly and rearwardly from the vertex 65. The lowermost end of the lower arm 61 includes the lower rear pivot 51, through which the movable seat mounting bracket 60 is pivotally interconnected with the rear pivot link 40. Approximately halfway between the lower rear pivot 51 and the vertex 65 of the lower arm 61 and the upper arm 62 is the upper rear pivot 41, through which the movable seat mounting bracket 60 is pivotally interconnected with the front pivot link 50. Those skilled in this art will appreciate that, although the movable seat mounting bracket 60 illustrated herein is preferred, any means that provides attachments for pivotal movement between the movable seat 70 and the rear and front pivot links 40, 50, such as sleeve bushings or direct attachment to apertures in the panels 73, 73*a*, is suitable for use with this invention.

Figure 4:
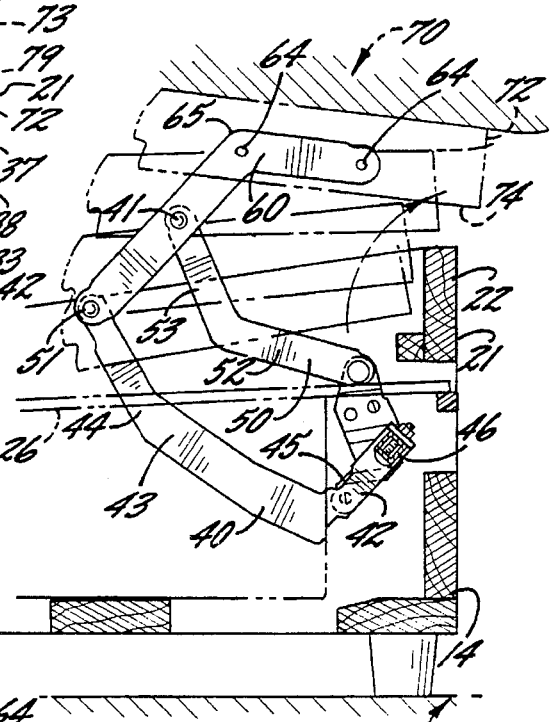
FIG. 4 is a cross-sectional view of a movable seat as it begins its travel from the closed to the open position.
Figure 5:
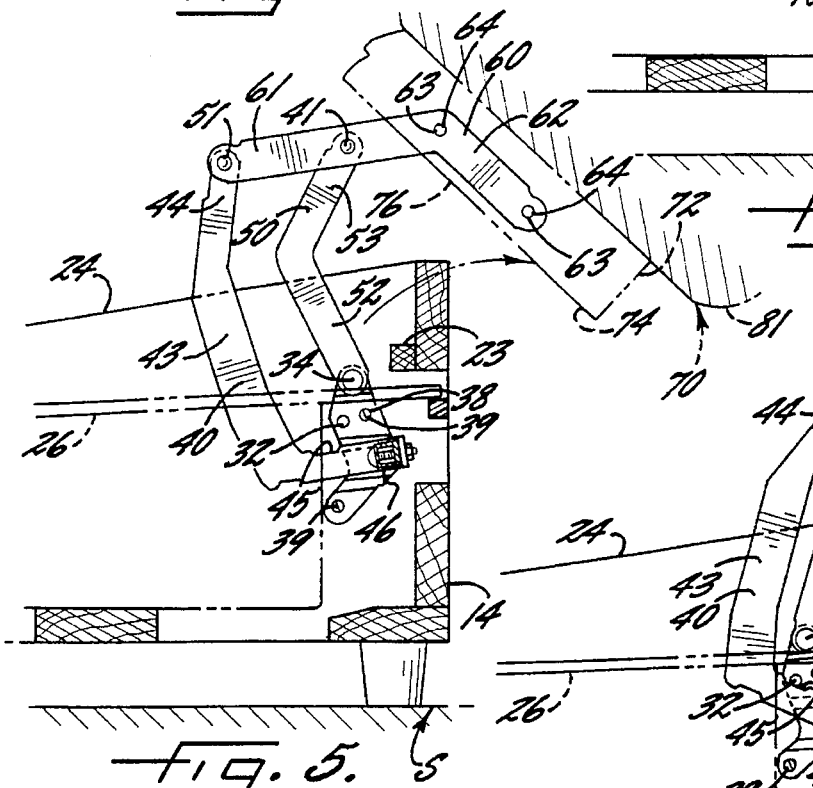
FIG. 5 is a cross-sectional view of a movable seat as it reaches its balance point.
Figure 6:
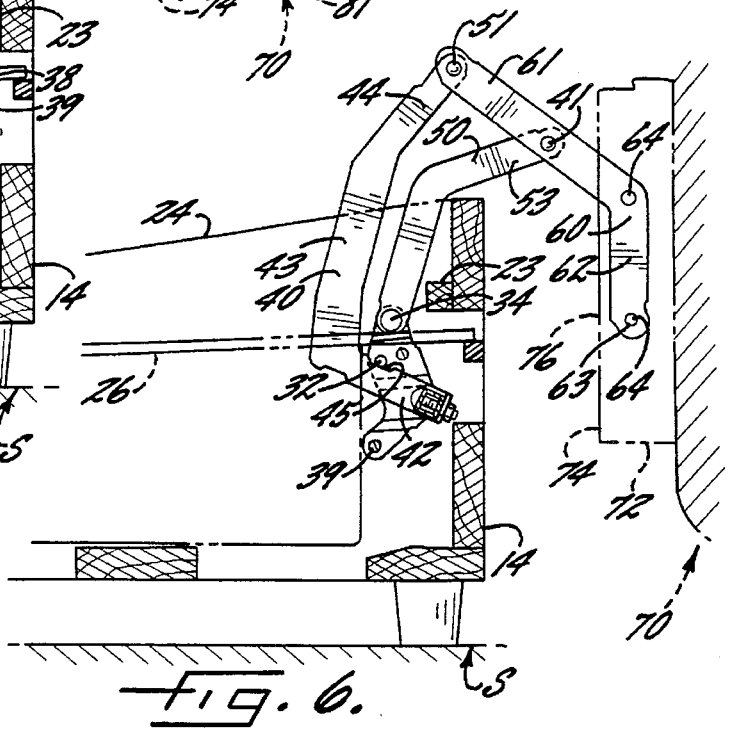
FIG. 6 is a cross-sectional view taken along line 6—6 of FIG. 1.

To move the movable seat 70 from the closed position of FIG. 3 to the open position of FIG. 6, an operator provides an upward force on the rear portion of the movable seat 70. This force draws the movable seat 70 and the movable seat mounting bracket 60 fixed thereto upwardly for a short distance (FIG. 4). This initial vertical movement allows the mounting frame 71, and in particular the front panel 72, of the movable seat 70 to avoid interfering with the front panel 22 of the base mounting frame 21. Typically a vertical rise of between 1 and 4 inches is sufficient for the movable seat 70 to clear the front panel 22. Continued application of an upward force to the movable seat 70 causes upward and forward movement of the pivots 41 and 51, which in turn draws the front pivot link 50 and rear pivot link 40 about pivots 41 and 51, respectively, so that the upper arms 53 and 44 move upwardly and forwardly. This action continues, with the movable seat 70 gradually rotating and translating from a generally horizontal disposition to a generally vertical disposition, until a stop pin notch 45 in the leading edge of the lower arm 42 of the front pivot link 40 strikes the stop pin 32 as the movable seat 70 reaches the open position (FIG. 6). In the open position, the front edge portion 81 of the movable seat 70 is adjacent to the floor. In this position the movable seat 70 is sufficiently removed from the base 12 that the storage bin 26 can be accessed by the operator.

It can be seen that in the closed position, the lower surface 74 of the front panel 72 of the movable seat 70 rests on the upper shelf 23 and the forward surface 79 of the front panel 72 resides rearwardly and slightly downwardly of the upper edge of the front panel 22 of the mounting frame 21. In this configuration, the sofa presents a aesthetically pleasing appearance. In contrast, in a seating unit having a movable seat hinged to the top of the front rail, the front edge of the movable seat rests upward of the upper edge of the front rail, presenting an exposed hinge which detracts from the appearance of the seating unit.

Further, it can be seen that in the open position, the front edge portion 81 of the movable seat 70 is adjacent the underlying surface S and the lower panel surfaces 74, 76, and 76*a* confront the front wall 14. In this configuration, the seating unit is quite resistant to toppling over due to a rearward or downward force applied to the movable seat 70 (the type of force applied by a child or pet climbing on or suspended from the movable seat 70). If such a force is applied to the movable seat 70, the sofa 10 tips only slightly before the front edge portion 81 of the movable seat 70 contacts the underlying surface S. From this tipped position, an extremely strong force must be applied to cause the sofa 10 to tip further. In contrast, a seating unit having a movable seat hinged to the top portion of the front wall that moves into a horizontally-disposed open position is quite susceptible to tipping due to a downward force on the movable seat, and is further susceptible to subsequently slamming shut in an inverted position. Preferably, in the open position the front edge portion 81 resides within 1 to 6 inches of the underlying surface; also, preferably the lower panel surfaces 74, 76, and 76*a* of the movable seat 70 are disposed within 1 to 4 inches of the front wall 14. Because the movable seat 70 is positioned so that its front edge portion 81 is adjacent the underlying floor in the open position, the seat 70 resides sufficiently low that it does not block the vision of an occupant of the seating unit who is attempting to watch television or converse, even if the movable seat 70 is positioned directly between the occupant and his object of interest.

In addition, because of the orientation of the movable seat 70 relative to the base 12 in the open position, and the path the movable seat 70 follows from the open to the closed position, the movable seat 70 of the present invention is less prone to slamming when moving from the open position to the closed position. As described above, the movable seat of a seating unit hinged to the top of a seating unit wall encourages, by its weight alone, movement to the closed position as the movable seat passes through an upright vertical orientation while moving to the closed position. Movement to the closed position is encouraged due to the center of gravity of the movable seat moving to a position over a portion of the seating unit footprint rearward of the pivot. Relatively little force is required to move the movable seat from the fully open inverted position to the upright position; small children and pets are certainly capable of providing such force. Also, the force with which the movable seat slams is significant, as the rear edge of the movable seat accelerates from a point located above the base at a height equal to that of the front-to-rear length of the movable seat.

In contrast, the front edge portion 81 of the movable seat 70 of the present invention initially travels essentially upwardly with substantially no forward or rearward movement prior to its moving any significant distance rearwardly in order for the movable seat 70 to avoid contacting the front panel 22 during operation. Generally this vertical distance is between about 4 to 12 inches. The movable seat 70 then moves both upwardly and rearwardly to the balanced position shown in FIG. 5. The shape of this path alone reduces the tendency of the movable seat 70 to slam, as considerable upward force is required to elevate the movable seat 70 to this position. Further, the balance point (i.e., the intermediate position in the travel path of the movable seat 70 as it moves from the open to the closed position beyond which it will encourage closing due to the weight of the movable seat) occurs in the illustrated embodiment as the movable seat 70 is disposed at an angle of between about 20 and 45 degrees relative to horizontal. In this position, the distance from the rear edge of the movable seat 70 (in this embodiment represented by the rear panel 78) to the top of the base 12 is considerably less than that for a simple hinged seating unit, and thus the slamming force due to free-falling acceleration is significantly decreased.

Those skilled in this art will appreciate that, although a four-bar linkage is illustrated herein, any means for moving the movable seat 70 between the closed position of FIG. 3 and the open position of FIG. 6 is suitable for use with the present invention. Exemplary alternatives include a single link pivotably interconnected to the movable seat 70 and the mounting frame 21 and a telescoping mechanism attached to the movable seat 70 and the mounting frame 21.

It is noteworthy that, because of the tripartite configuration of the rear pivot link 40 and the front pivot link 50 and the angled configuration of the movable seat mounting bracket 60, very little of the material comprising these links is visually exposed above the base 12. This improves the appearance of the seating unit with the movable seat 70 in the open position. Also, there are no "pinch-points" created during the opening of the movable seat 70 between these links and the front panel 22; instead, the tripartite configuration of the rear pivot link 40 and the angled configuration of front pivot link 50 and the movable seat mounting bracket 60 cause these links to be spaced away from the internal and external surfaces and the top edge of the front panel 22. Preferably, the distance between these links and the rail is between about 0.5 and 3 inches, and more preferably is between about 1.5 and 3 inches. Those skilled in this art will appreciate that smoothly curved links that approximate the tripartite profile of the rear pivot link 40 and the angled profile of the front pivot link 50 and the movable seat mounting bracket 60 could also be employed with this invention and provide the same benefits as the links illustrated herein. In particular, a front pivot link having a lower portion that resides rearwardly of the front panel 22 and an upper portion that resides above the front panel 22 in the open position is preferred. Also, a rear pivot link that includes a central portion that resides rearwardly of the lower arm 52 is preferred.

The foregoing embodiments are illustrative of the present invention, and are not to be construed as limiting thereof. The invention is defined by the following claims, with equivalents of the claims to be included therein.

What which is claimed:

1. A seating unit comprising:

(a) a base adapted for supporting said seating unit on an underlying surface, said base having upright wall means;

(b) a movable seat having a seating surface a lower surface opposed to said seating surface, and a front edge portion; and (c) four-bar linkage means for moving said movable seat between a closed position, in which said seating surface of said movable seat is disposed generally horizontally, and an open position, in which said seating surface of said movable seat is generally vertically disposed and forwardly facing, said lower surface of said movable seat confronts said upright wall means, and said front edge portion is adjacent the underlying surface, said moving means interconnecting said base and said movable seat, said four bar linkage means comprising:

mounting means attached to said base:

a front pivot link pivotally interconnected with said mounting means at a first pivot;

a rear pivot link pivotally interconnected with said mounting means at a second pivot, said first pivot being positioned upwardly and rearwardly of said second pivot; and mounting means attached to said movable seat, pivotally interconnected with said rear pivot link at a third pivot, and further pivotally interconnected to said front pivot link at a fourth pivot, said third pivot being positioned upwardly and rearwardly of said fourth pivot when said movable seat is in the open position.

2. A seating unit according to claim 1, wherein said front pivot link comprises a lower arm and an upper arm, said lower arm being pivotally interconnected with said base mounting means at said first pivot and being fixed to one end of said upper arm, said fourth pivot being located on said upper arm, and said lower and upper arms being configured so that when said movable seat is in the open position, said lower arm is disposed rearwardly of said upright wall means, and said upper arm is disposed above said upright wall means.

3. A seating unit according to claim 1, wherein said seat mounting means comprises a mounting bracket fixed to said movable seat, said mounting bracket including an extension arm disposed below said lower surface of said movable seat in the closed position, and said third and fourth pivots are positioned on said extension arm.

4. A mechanism suitable for use with a seating unit which includes a base adapted for supporting said seating unit on an underlying surface, the base having upright wall means, a movable seat having a seating surface, a lower surface opposed to said seating surface, and a front edge portion, said movable seat being movable between a closed position, in which said seating surface of said movable seat is disposed generally horizontally, and an open position, in which said seating surface of said movable seat is generally vertically disposed and forwardly facing and said front edge portion is adjacent the underlying surface, said mechanism comprising:

(a) mounting means adapted to be attached to said base;

(b) a front pivot link comprising a lower arm and an upper arm, said lower arm being pivotally interconnected with said mounting means at a first pivot and being fixed to one end of said upper arm, said lower and upper arms being configured so that when said movable seat is in the open position, said lower arm is disposed rearwardly of said upright wall means, and said upper arm is disposed above said upright wall means;

(c) a rear pivot link pivotally interconnected with said mounting means at a second pivot; and (d) mounting means adapted to be attached to said movable seat, said seat mounting means being pivotally interconnected with said rear pivot link at a third pivot, and being further pivotally interconnected to said upper arm of said front pivot link at a fourth pivot, said third pivot being positioned upwardly and rearwardly of said fourth pivot when said movable seat is in the open position.

5. A mechanism according to claim 4, wherein said seat mounting means comprises a mounting bracket adapted to be fixed to said movable seat having an extension arm that extends upwardly and rearwardly from said lower surface of said movable seat when said seat is in the open position, and wherein said third pivot and said fourth pivot are located on said extension arm.

6. A mechanism according to claim 4, wherein said base mounting means comprises a base mounting bracket, and wherein said first pivot is located on said base mounting bracket upwardly and rearwardly of said second pivot.

7. A mechanism according to claim 4, wherein said upper and lower arms of said front pivot link are configured so that in the open position, a gap of between 0.5 and 3 inches is formed between said front pivot link and said upright wall means.

8. A mechanism according to claim 4, wherein said rear pivot link comprises serially fixed lower, central, and upper arms, said second pivot being located on said lower arm, said third pivot being located on said upper arm, and said lower, central, and upper arms being configured so that when said movable seat is in the open position, said central portion of said rear pivot link is disposed rearwardly of said lower arm of said front pivot link.

9. A seating unit comprising:

(a) A base adapted for supporting said seating unit on an underlying surface, said base having upright wall means;

(b) a movable seat having a seating surface, a lower surface opposed to said seating surface, and a front edge portion; and (c) means for moving said movable seat between a closed position, in which said seating surface of said movable seat is disposed generally horizontally, and an open position, in which said seating surface of said movable seat is generally vertically disposed and forwardly facing and said front edge portion is positioned within 6 inches to about 1 inch from the underlying surface, said moving means pivotally interconnecting said base and said movable seats, wherein said moving means is configured so that, in moving from the closed position to the open position, said movable seat initially moves essentially vertically.

10. A seating unit according to claim 9 wherein said moving means is configured so that, in moving from the open position to the closed position, said front edge portion of said movable seat moves essentially vertically for between about 4 to 12 inches prior to moving rearwardly.

11. A seating unit according to claim 9, wherein said base includes a storage receptacle positioned beneath said movable seat when said movable seat is in the closed position.

12. A seating unit according to claim 9, wherein said moving means is configured so that in the open position, said lower surface of said movable seat confronts said upright wall means.

13. A seating unit according to claim 12, wherein said moving means is configured so that said lower surface of said movable seat is positioned between about 1 and 4 inches from said upright wall means of said base when said movable seat is in the open position.

14. A seating unit comprising:

(a) a base adapted for supporting said seating unit on an underlying surface, said base having upright wall means and a support frame defining a cavity;

(b) a movable seat having a seating surface, a lower surface opposed to said seating surface and including a frame, and a front edge portion; and (c) means for moving said movable seat between a closed position, in which said seating surface of said movable seat is disposed generally horizontally, with said movable seat frame being nested within a cavity defined by said base support frame, and an open position, in which said seating surface of said movable seat is generally vertically disposed and forwardly facing and said front edge portion is adjacent the underlying surface, said moving means pivotally interconnecting said base and said movable seat, wherein said moving means is configured so that, in moving from the closed position to the open position, said movable seat initially moves essentially vertically.

15. The seating unit of claim 14, wherein said means for moving said movable seat is configured so that, in moving from the closed position toward the open position, said movable seat initially rises substantially vertically from the cavity between about 1 and 4 inches to avoid interference between said base support frame and said movable seat frame.

16. A seating unit according to claim 14 wherein said moving means is configured so that, in moving from the open position to the closed position, said front edge portion of said movable seat moves essentially vertically for between about 4 to 12 inches prior to moving rearwardly.

17. A seating unit according to claim 14, wherein said base includes a storage receptacle positioned beneath said movable seat when said movable seat is in the closed position.

18. A seating unit according to claim 14, wherein said moving means is configured so that in the open position, said lower surface of said movable seat confronts said upright wall means.

19. A seating unit according to claim 18 wherein said moving means is configured so that said lower surface of said movable seat is positioned between about 1 and 4 inches from said upright wall means of said base when said movable seat is in the open position.

20. A seating unit comprising:

(a) a base adapted for supporting said seating unit on an underlying surface, said base having upright wall means;

(b) a movable seat having a seating surface, a lower surface opposed to said seating surface, and a front edge portion;

(c) at least one stationary scat having a generally horizontal upper seat surface positioned above said base; and (c) means for moving said movable scat between a closed position, in which said seating surface of said movable seat is disposed generally horizontally and is adjacent and generally coplanar with said stationary seat upper seat surface, and an open position, in which said seating surface of said movable seat is generally vertically disposed and forwardly facing and said front edge portion is adjacent the underlying surface, said moving means pivotally interconnecting said base and said movable seat.

21. The seating unit of claim 20, wherein said at least one stationary seat comprises two stationary seats, and wherein in the closed position, said seating surface of said movable seat is adjacent, generally coplanar with, and between said two stationary seat upper seat surfaces.

* * * * *